United States Patent [19]

Keane

[11] Patent Number: 4,557,535

[45] Date of Patent: Dec. 10, 1985

[54] ELECTRICAL HOSE SWIVEL CONNECTOR FOR CANISTER VACUUM CLEANER

[75] Inventor: James W. Keane, White Bear Lake, Minn.

[73] Assignee: Whirlpool Corporation, Benton Harbor, Mich.

[21] Appl. No.: 651,103

[22] Filed: Sep. 17, 1984

[51] Int. Cl.[4] ..... H01R 39/00

[52] U.S. Cl. ..... 339/5 R; 339/16 R

[58] Field of Search ..... 339/5, 6, 8, 15, 16

[56] References Cited

U.S. PATENT DOCUMENTS

| | | | |
|---|---|---|---|
| 2,769,997 | 11/1956 | Sheahan | 15/324 |
| 2,958,894 | 11/1960 | Carabet | 15/327 |
| 3,002,216 | 10/1961 | Beach | 15/327 |
| 3,339,168 | 8/1967 | Belicka et al. | 339/5 |
| 3,387,319 | 6/1968 | Ferraris et al. | 15/327 |
| 3,434,092 | 3/1969 | Brown et al. | 339/16 |
| 3,470,521 | 9/1969 | Downey | 339/8 |
| 3,534,317 | 10/1970 | Descarries et al. | 339/7 |
| 3,546,656 | 12/1970 | Pritulsky | 335/16 |
| 3,614,705 | 10/1971 | Descarries et al. | 339/8 R |
| 3,785,049 | 1/1974 | Kanamaru et al. | 29/629 |
| 4,003,616 | 1/1977 | Springer | 339/8 R |
| 4,117,287 | 9/1978 | Walker et al. | 339/16 R |
| 4,143,930 | 3/1979 | Schauer | 339/6 R |

*Primary Examiner*—Joseph H. McGlynn

*Attorney, Agent, or Firm*—Wood, Dalton, Phillips, Mason & Rowe

[57] ABSTRACT

A vacuum cleaner having a hose swivelly connected to a canister portion suction inlet. The canister portion includes an electrical power connector adjacent the inlet opening. The hose is provided with electrical power conducting means. The swivel connector has a first portion secured to the hose end and a second portion adapted to be removably secured to the canister housing inlet. The first swivel connector portion is swivelly connected to the second portion. An electrical power plug is removably mounted to the swivel connector second portion and a first interlock is provided on the plug and swivel connector second portion for releasably locking the plug to the swivel connector second portion. A second interlock is provided on the plug and swivel connector first portion for preventing axial separation of the first and second swivel connector portions. Cooperating electrical connectors are provided on the plug and swivel connector first portion for electrically connecting the electrical power connector to the electrical power conductor with the swivel connector to the electrical power conductor with the swivel connector first and second portions in any one of an infinite plurality of different angularly related swivel positions.

18 Claims, 4 Drawing Figures

ELECTRICAL HOSE SWIVEL CONNECTOR FOR CANISTER VACUUM CLEANER

BACKGROUND OF THE INVENTION

1. Field of the Invention

This invention relates to vacuum cleaners and in particular to a swivel connector for connecting one end of a suction hose to a canister vacuum cleaner.

2. Description of the Background Art

In one conventional form of vacuum cleaner, an air suction unit and filter bag assembly is provided within a canister. Associated with the canister is a power nozzle floor tool which includes a brush driven by an electric motor. The dirt pickup power nozzle is connected to one end of a wand, in turn connected through a flexible hose provided with electrical conductors to the canister, whereby dirt-laden air is sucked into the nozzle, through the wand and hose into the filter bag within the canister. The flexibility of the hose permits the user to effect the floor cleaning operation at different positions relative to the canister. However, it has been found that a fixed connection of the hose end to the canister duly limits the freedom of movement of the user and it has been found desirable to provide a swivel connection of the hose end to the canister for further improved facility in the cleaning operation.

A problem arises in the provision of swivel connectors in the use of nozzles provided with power driven brushes and the like. In such vacuum cleaners, it is necessary to provide electrical conductors from the canister through the hose and wand to the electrical equipment and the nozzle. Thus, it is necessary to provide disconnectible electrical connection means in the means for connecting the hose end to the canister. Where it is desirable to provide a swivel connection, difficulties have arisen in the structures of the prior art in maintaining positive electrical connection across the swivel joint.

It is further desirable to arrange the electrical connector carried by the hose and connector so that an automatic electrical connection is made with the complementary electrical connector carried by the canister as an incident of connecting the hose to the canister. Once the electrical connection is made, it is necessary to maintain good electrical contact between the mating portions thereof, notwithstanding the swiveling movement of the hose end.

In U.S. Pat. No. 2,769,997, Robert E. Sheahan discloses an electric cord arrangement for vacuum cleaners wherein a canister is provided with a swiveled head to which a suction hose is connected. Slip rings are connected to a plug receptacle carried by the swiveled head. A stationary part adjacent to the swiveled head is provided with brushes bearing on the slip rings and through which the slip rings may be connected to an electric circuit. The suction hose is provided with an electric cord which extends lengthwise thereof and is provided at one end with a plug for connection with the plug receptacle. The other end of the cord is provided with an electric lamp adapted to be detachably positioned in a socket on the cleaning tool. Where the cleaning tool has an electric motor-driven brush, the lamp base embodies a female connector for connection with a plug wired to the brush motor.

Raymond Descarries et al. disclose, in U.S. Pat. No. 3,534,317, another form of connector for use in a vacuum cleaner wherein one end of the hose is provided with an electric terminal automatically connecting the hose conductors with the conductors of a telescoping wand. The wand is provided with a sliding contact so that in any of its retracted and elongated positions, current is conducted to the motorized brush tool removably attached to one end of the wand.

A somewhat similar vacuum cleaner construction is shown in U.S. Pat. No. 3,614,705 of Raymond Descarriers et al.

A slip ring assembly and method of making the same is disclosed by Hisanobu Kanamaru et al in U.S. Pat. No. 3,785,049. The slip ring assembly, as disclosed therein, includes a molded cylindrical base, conductive rings and terminals assembled together and fitted in diametrically spaced grooves formed on the base. Conductive rings are press-fitted on the cylindrial base to bring the conductive rings into pressure contact with respective terminals for ensuring engagement of the conductive rings with the cylindrical base.

SUMMARY OF THE INVENTION

The present invention comprehends an improved vacuum cleaner construction for use with a canister housing suction inlet opening and an electrical power connector adjacent the opening. A hose is provided for conducting dirt-laden air to the suction opening and the hose is provided with electrical power conducting means. The invention comprehends providing in association therewith a swivel connector having a first portion secured to the hose end, and a second portion adapted to be removably secured to the housing in the suction inlet opening, the first portion being swivelly connected to the second portion, an electrical power plug removably mounted to the swivel connector second portion, first cooperating interlock means on the plug and swivel connector second portion for releasably locking the plug to the swivel connector second portion, second cooperating interlock means on the plug and swivel connector first portion for preventing axial separation of the first and second swivel connector portions, and cooperating electrical connection means on the plug and the swivel connector first portion for electrically connecting the electrical power connector to the electrical power conducting means with the swivel connector first and second portions in any one of a plurality of different angularly related swivel positions.

The present invention also comprehends an improved hose construction adapted for use in a vacuum cleaner wherein the hose is used for conveying an air stream between components of the vacuum cleaner and includes a plurality of electrical conductors connecting the components and wherein the hose includes a swivel connector on an end portion thereof for improved flexibility in use of the components.

The swivel connector is arranged for electrical connection of the electrical power connector to the electrical power conducting means with the swivel connector first and second portions in any one of a plurality of unlimited different angularly related swivel positions.

In the illustrated embodiment, an enclosure is provided on the swivel connector second portion and the electrical power plug is removably mounted to the swivel connector second portion in the enclosure.

In the illustrated embodiment, the first interlock means comprises resiliently deflectible catch means on the plug and cooperating fixed latch means on the swivel connector second portion.

In the illustrated embodiment, the enclosure is provided with an opening defining cooperating fixed latch means on the swivel connector second portion.

In the illustrated embodiment, the electrical connection means includes annular slide rings on the swivel connection first portion and slide contacts on the plug slidably engaging the slide rings. The second interlock means comprises an annular shoulder on the swivel connector first portion and a complementary locking shoulder on the plug.

In the illustrated embodiment, the enclosure comprises an integral portion of the swivel connector second portion.

Further in the illustrated embodiment, the first interlock means comprises resilient deflectible catch means on the plug and cooperating fixed latch means on the swivel connector second portion, and the second interlock means comprises an annular, radially outwardly opening groove on the swivel connector first portion and a complementary arcuate locking shoulder on the plug.

The vacuum cleaner construction of the present invention is extremely simple and economical, while yet providing a highly improved swivel connection for the hose to the canister providing maintained, positive electrical contact notwithstanding swiveling of the hose over an unlimited range.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
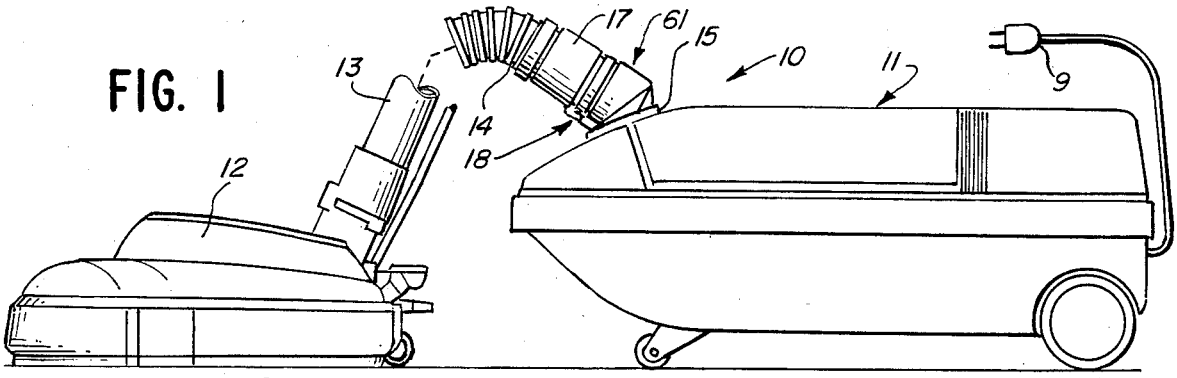
FIG. 1 is a fragmentary side elevation of a vacuum cleaner having an improved swivel connecting means embodying the invention.

In the illustrative embodiment of the invention as disclosed in the drawing, a vacuum cleaner generally designated 10 is shown to comprise a canister-type vacuum cleaner having a wheeled canister 11 and a wheeled power nozzle 12 connected to the canister 11 through a wand 13 and a flexible suction hose 14. The canister vacuum cleaner is provided with electrical power through a cord and plug assembly 9 which is adapted to be plugged in a known manner into a suitable power source receptacle. One end of the suction hose 14 is connected by suitable connection means including a conventional handle, (not shown) to the wand 13, which is connected to nozzle 12. The suction hose 14 is connected to the canister through a suction inlet 15 opening to a filter bag (not shown) in the canister for filtering of dirt from the dirt-laden air delivered from the nozzle in the dirt-cleaning operation.

In the illustrated embodiment, the nozzle requires electrical power thereto, such as for operation of a power-driven brush assembly (not shown), and hose 14 is provided with electrical conductors 16 for delivering electrical power thereto.

More specifically, hose 14 defines an end 17 which is connected to the inlet 15 through a swivel connector generally designated 18. The swivel connector is adapted for providingly unlimited swiveling movement of the hose end 14 about its longitudinal axis for facilitated use of the wheeled nozzle 12 in carrying out the floor cleaning operation. In the illustrated embodiment, the swivel connector provides a three-wire electrical connection which, alternatively, may be used as a two-wire electrical connction where the hose 14 is provided with two-wire electrical conduction means.

Figure 2:
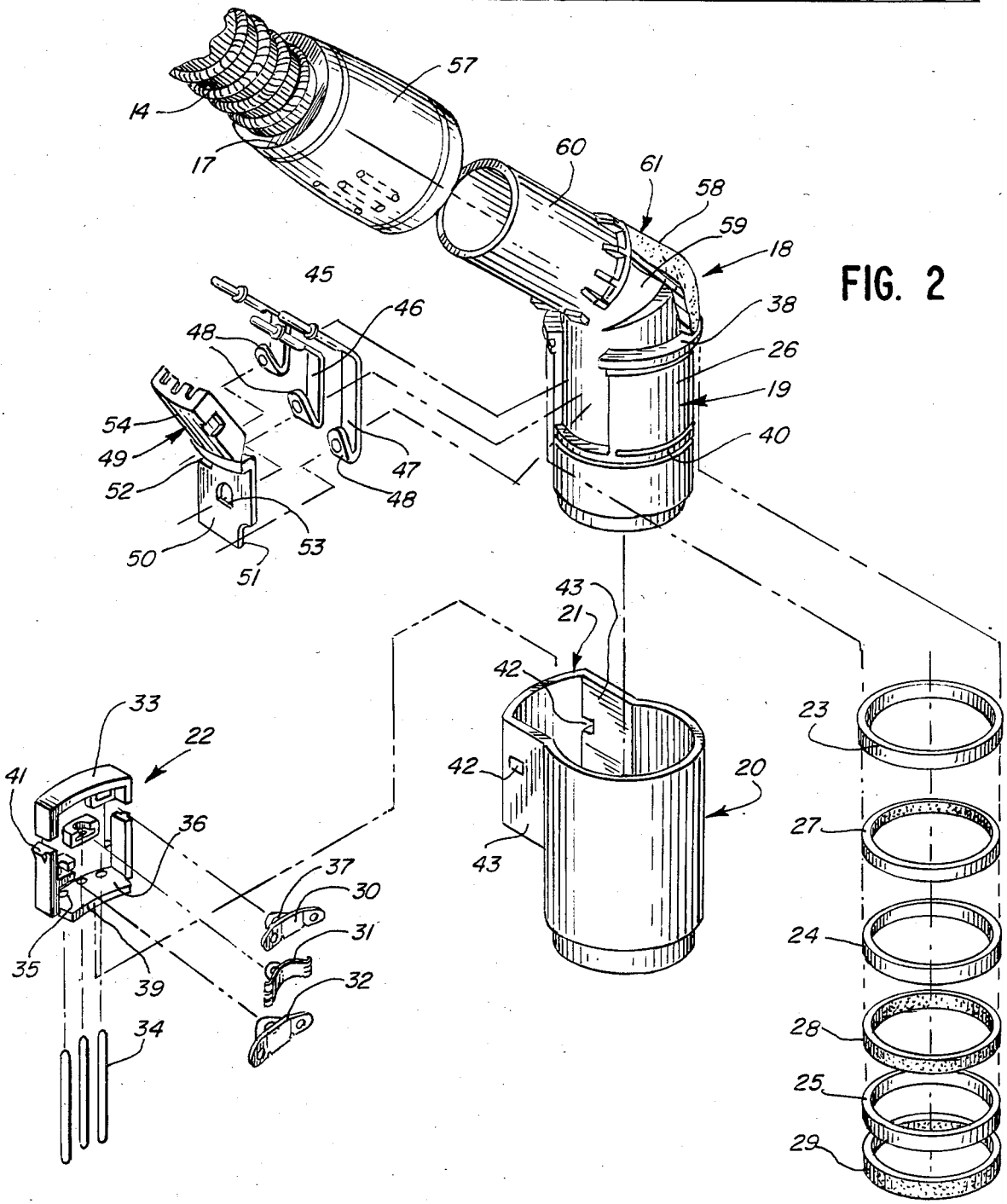
FIG. 2 is a fragmentary exploded perspective view illustrating the swivel connector in greater detail.
Figure 3:
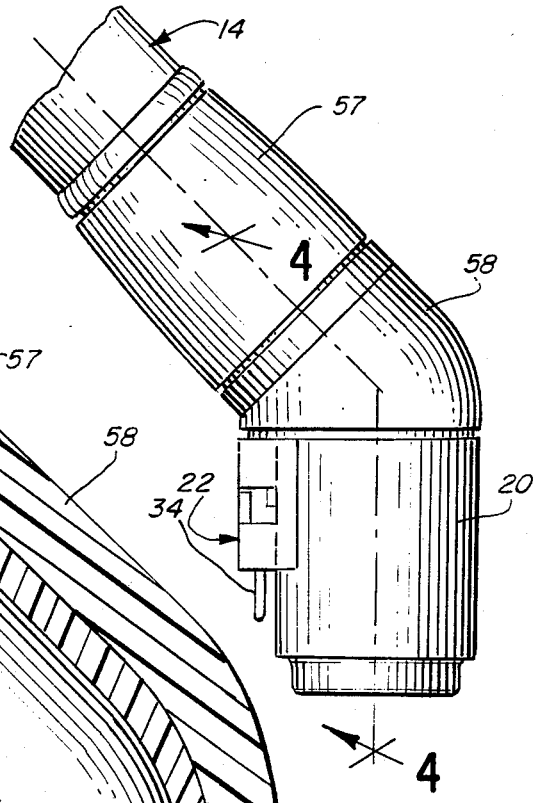
FIG. 3 is a fragmentary side elevation of the swivel hose connection.

More specifically, the swivel connector 18 is shown in detail in FIG. 2 to include an inner swivel tube 19 received in a tubular housing 20 defining an enclosure portion 21 for receiving an electrical plug generally designated 22.

A plurality of slip rings 23, 24 and 25 are coaxially mounted on a midportion 26 of the inner swivel tube 19. The slip rings are formed from a suitable metal having high electrical conductivity and are electrically insulated from each other by coaxial insulating spacers 27 and 28 and a lowermost insulating gasket 29.

The plug 22 is provided with three metal slide contacts 30, 31 and 32 exposed to have sliding electrical contact with rings 23, 24 and 25, respectively. The slide contacts are received in a housing portion 33 of the plug. Three connector pins 34 extend through suitable openings 35 in an end wall 36 of the plug housing. The pins are received in suitable openings 37 in the slide contacts 30, 31 and 32, respectively, to provide electrical connection between the pins and the slide contacts within the housing.

The stack of slide rings, insulating spacers, and gaskets 23–29 is retained between an annular rib 38 on the swivel connector tub 19 and the inner end 39 of the end wall 36 of plug 22 received in an annular groove 40 on the inner swivel tube 19.

As further seen in FIG. 2, plug housing 33 includes a pair of oppositely projecting resilient ears 41, which snap through openings 42 in the sidewalls 43 of the enclosure portion 21 of housing 20 to lock the plug to the housing.

Figure 4:
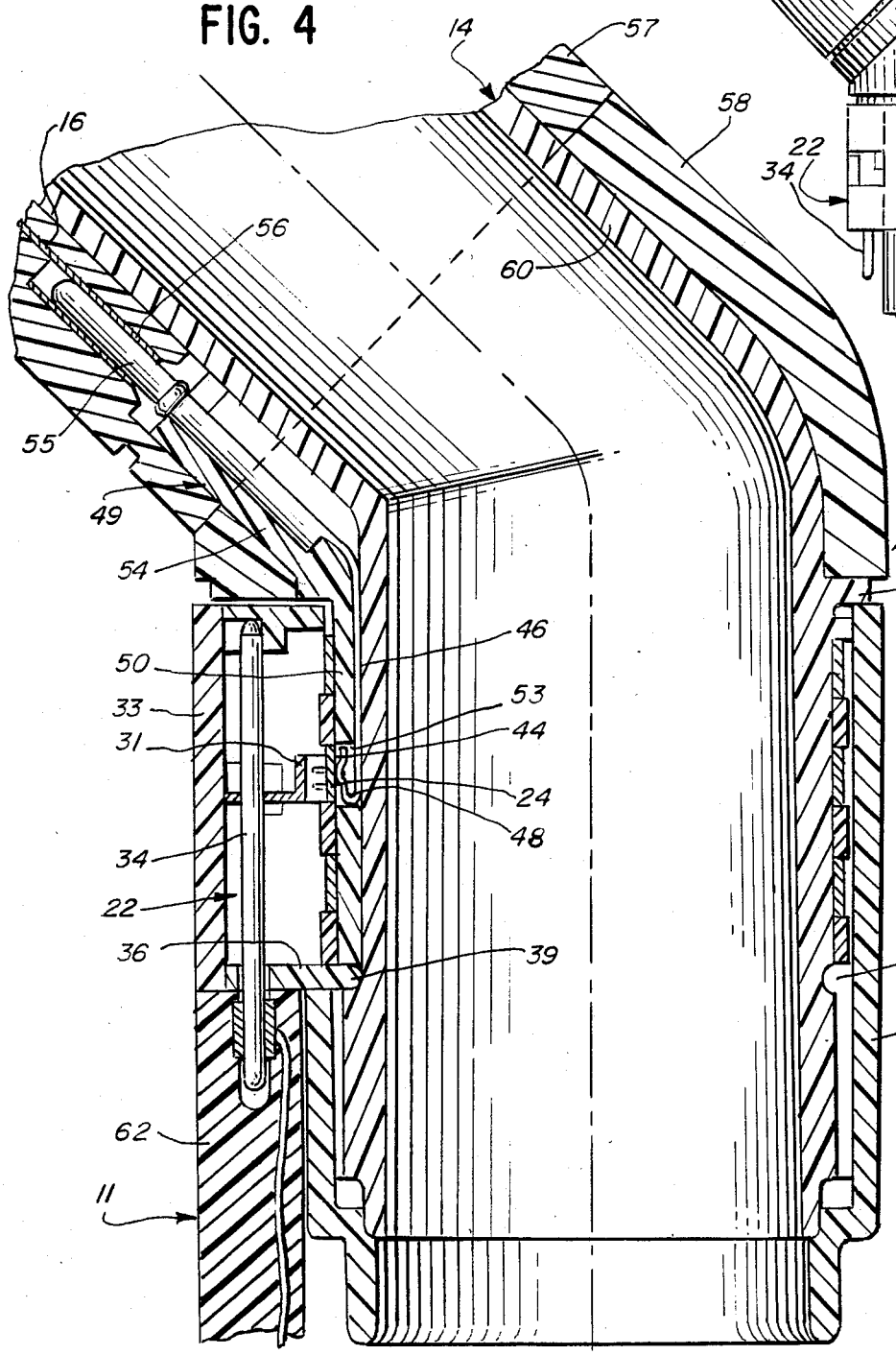
FIG. 4 is a fragmentary enlarged diametric section taken substantially along the line 4—4 of FIG. 3.

Electrical connection is made from the inner surface 44 of the slip rings 23 to the hose conductor 16 by electrical connectors 45, 46 and 47, each having a lower turned springy portion 48 engaging the respective slip rings. A terminal shield generally designated 49 is provided having a lower portion 50 provided with notches 51 and 52 and opening 53 for permitting the springy ends 48 of the terminals to extend therethrough into electrical contact with the slip rings, as best seen in FIG. 4.

The upper portion 54 of the terminal shield 49 receives turned pin ends 55 of the electrical contacts 45, 46 and 47, respectively, which, in turn, are received in sockets 56 connected to the wires 16 in the cuff 57 of the hose end 17.

An elbow hose link 58 is received around a turned portion 59 of swivel tube 19 and an upper angled tubular portion 60 of the swivel tube 19 is frictionally retained in the cuff 57 to complete the assembly.

The electrical hose swivel connector assembly generally dessignated 61 is extremely simple and economical of construction while yet providing highly improved unlimited swiveling about the longitudinal axis of the hose so as to permit facilitated use of the vacuum cleaner. As indicated above, the electrical plug 22 cooperates with the movable components of the assembly so as to provide maintained assembly without the need for connecting elements, such as screws and the like, and provides for facilitated swiveling while maintaining the desired assembled association of the components. The male connector pins 34 of swivel connector plug 22 are positioned to be automatically received in a female connector 62 which advantageously may be mounted in canister 11 within the inlet opening 15 which is formed in the housing of canister 11 so that an electrical connection is automatically made as an incident of connecting the hose end swivel connector 18 to the canister inlet opening 15. Thus, female connector 62 comprises an electrical power connector at the canister inlet opening, which is electrically connected to electrical circuitry (not shown) disposed internally of vacuum cleaner canister 11, which circuitry is connected to a power source through cord and plug assembly 9 which is automatically electrically connected to the power-conducting means of connector assembly 61 as an incident of connecting the hose end to inlet 15.

The plug ears 41 and cooperating housing openings 42 define first cooperating interlock means on the plug and swivel connector second portion 21, and second cooperating interlock means on the plug and swivel connector first portion 26 are provided in the form of the plug end wall 39 slidably received in the groove 40 for preventing axial separation of the first and second swivel connector portions 19 and 20.

The foregoing disclosure of specific embodiments is illustrative of the broad inventive concepts comprehended by the invention.

I claim:

1. In a vacuum cleaner having a canister housing defining a suction inlet opening and an electrical power connector adjacent said opening, and a hose for conducting dirt-laden air to said suction opening and provided with electrical power-conducting means, the improvement comprising:

a swivel connector having a first portion secured to said hose end, and a second portion adapted to be removably secured to said housing in said suction inlet opening, said first portion being swivelly connected to said second portion;

an electrical power plug removably mounted to said swivel connector second portion;

first cooperating interlock means on said plug and swivel connector second portion for releasably locking the plug to said swivel connector second portion;

second cooperating interlock means on said plug and swivel connector first portion for preventing axial separation of said first and second swivel connector portions; and cooperating electrical connection means on said plug and said swivel connector first portion for electrically connecting said electrical power connector to said electrical power-conducting means with said swivel connector first and second portions in any one of a plurality of different angularly related swivel positions.

2. The vacuum cleaner swivel connector of claim 1 wherein said second interlock means comprises an annular shoulder on said swivel connector first portion and a complementary locking shoulder on said plug.

3. The vacuum cleaner swivel connector of claim 1 wherein said second interlock means comprises an annular, radially outwardly opening groove on said swivel connector first portion and a complementary locking shoulder on said plug.

4. The vacuum cleaner swivel connector of claim 1 wherein said second interlock means comprises an annular, radially outwardly opening groove on said swivel connector first portion and a complementary arcuate locking shoulder on said plug.

5. In a vacuum cleaner having a canister housing defining a suction inlet opening and an electrical power connector adjacent said opening, and a hose for conducting dirt-laden air to said suction opening and provided with electrical power-conducting means, the improvement comprising:

a swivel connector having a first portion secured to said hose end, and a second portion adapted to be removably secured to said housing in said suction inlet opening, said first portion being swivelly connected to said second portion;

an electrical power plug removably mounted to said swivel connector second portion;

first cooperating interlock means on said plug and swivel connector second portion for releasably locking the plug to said swivel connector second portion;

second cooperating interlock means on said plug and swivel connector first portion for preventing axial separation of said first and second swivel connector portions; and cooperating electrical connection means on said plug and said swivel connector first portion for electrically connecting said electrical power connector to said electrical power-conducting means with said swivel connector first and second portions in any one of a plurality of unlimited different angularly related swivel positions.

6. The vacuum cleaner swivel connector of claim 5 wherein said electrical connection means includes annular slide rings on said swivel connector first portion and slide contacts on said plug slidably engaging said slide rings.

7. The vacuum cleaner swivel connector of claim 5 wherein said electrical connection means includes annular slide rings on said swivel connector first portion and slide contacts on sid plug slidably engaging said slide rings, said second interlock means comprising an annular shoulder on said swivel connector first portion and a complementary locking shoulder on said plug.

8. In a vacuum cleaner having a canister housing defining a suction inlet opening and an electrical power connector adjacent said opening, and a hose for conducting dirt-laden air to said suction opening and provided with electrical power-conducting means, the improvement comprising:

a swivel connector having a first portion secured to said hose end, and a second portion adapted to be removably secured to said housing in said suction inlet opening, said first portion being swivelly connected to said second portion;

an enclosure on said swivel connector second portion;

an electrical power plug removably mounted to said swivel connector second portion in said enclosure;

first cooperating interlock means on said plug and enclosure for releasably locking the plug to said swivel connector second portion;

second cooperating interlock means on said plug and swivel connector first portion for preventing axial separation of said first and second swivel connector portions; and cooperating electrical connection means on said plug and said swivel connector first portion for electrically connecting said electrical power connector to said electrical power-conducting means with said swivel connector first and second portions in any one of a plurality of different angularly related swivel positions.

9. The vacuum cleaner swivel connector of claim 8 wherein said first interlock means comprises resiliently deflectible catch means.

10. The vacuum cleaner swivel connector of claim 8 wherein said first interlock means comprises resiliently deflectible catch means on said plug and cooperating fixed latch means on said swivel connector second portion.

11. The vacuum cleaner swivel connector of claim 8 wherein said first interlock means comprises resiliently deflectible catch means on said plug and an opening in said enclosure defining cooperating fixed latch means on said swivel connector second portion.

12. The vacuum cleaner swivel connector of claim 8 wherein said first interlock means comprises a pair of catches and a cooperating pair of latches.

13. The vacuum cleaner swivel connector of claim 8 wherein said first interlock means comprises a pair of oppositely disposed catches and a cooperating pair of latches.

14. The vacuum cleaner swivel connector of claim 8 wherein said electrical connection means includes annular slide rings on said swivel connector first portion and slide contacts on said plug slidably engaging said slide rings.

15. The vacuum cleaner swivel connector of claim 8 wherein said electrical connection means includes annular slide rings on said swivel connector first portion and slide contacts on said plug slidably engaging said slide rings, said swivel connector first portion and at complementary locking shoulder on said plug.

16. The vacuum cleaner swivel connector of claim 8 wherein said enclosure comprises an integral portion of said swivel connector second portion.

17. The vacuum cleaner swivel connector of claim 8 wherein said first interlock means comprises resiliently deflectible catch means on said plug and cooperating fixed catch means on said swivel connector second portion, and said second interlock means comprises an annular, radially outwardly opening groove on said swivel connector first portion and a complementary arcuate locking shoulder on said plug.

18. In a vacuum cleaner hose for conducting dirt-laden air to a suction inlet opening formed in a vacuum cleaner housing, said hose being provided with electrical power-conducting means, the improvement comprising:

a swivel connector having a first portion secured to an end of said hose, and a second portion adapted to be removably secured to said housing in said suction inlet opening, said first portion being swivelly connected to said second portion;

an enclosure formed on said swivel connector second portion;

an electrical power plug removably mounted to said swivel connector second portion in said enclosure;

first cooperating interlock means on said plug and enclosure for releasably locking the plug to said swivel connector second portion;

second cooperating interlock means on said plug and swivel connector first portion for preventing axial separation of said first and second swivel connector portions; and is;

cooperating electrical connection means on said plug and said swivel connector first portion for electrically connecting said-electrical power connector to said electrical power-conducting means with said swivel connector first and second portions in any one of a plurality of different angularly related swivel positions.

* * * * *